US005598945A

United States Patent [19]

Gracy

[11] Patent Number: 5,598,945

[45] Date of Patent: Feb. 4, 1997

[54] NON VENTED SPILL-PROOF LID

[76] Inventor: Mark S. Gracy, 2121 Noblestown Rd., Suite 200, Pittsburgh, Pa. 15205

[21] Appl. No.: 541,296

[22] Filed: Oct. 10, 1995

[51] Int. Cl.[6] ..... A47G 19/22

[52] U.S. Cl. ..... 220/707; 220/709; 215/229; 215/388

[58] Field of Search ..... 220/705, 707, 220/709, 719, 212; 215/11.6, 388, 389, 229

[56] References Cited

U.S. PATENT DOCUMENTS

| | | | |
|---|---|---|---|
| 2,914,214 | 11/1959 | Messinger | 220/705 |
| 3,178,081 | 4/1965 | Adams | 215/391 X |
| 3,661,288 | 5/1972 | Noll | 215/388 X |
| 4,915,250 | 4/1990 | Hayes, Jr. . | |
| 5,211,298 | 5/1993 | Bloch | 215/11.1 |
| 5,439,125 | 8/1995 | Bloch | 215/229 |

*Primary Examiner*—Stephen Cronin

[57] ABSTRACT

A spill-proof lid for use with a container for liquids includes a liquid chamber that has an outlet opening above and inlet opening below the plane of the lid. The chamber is constructed so that, as it extends from inlet to outlet, it travels from the outlet opening closely to the side of the cup to the bottom where it then crosses the bottom, up the other side and back to the inlet opening. The periphery of the lid is constructed to sealingly engage the upper edge of the container. Preferably, the outlet end of the liquid chamber has a mouthpiece formed thereon for ease of drinking. In the preferred embodiment of the lid, the liquid chamber is substantially a single-loop helix.

5 Claims, 3 Drawing Sheets

NON VENTED SPILL-PROOF LID

BACKGROUND OF THE INVENTION

1. Field of the Invention

This invention relates to lids for covering containers for liquids, such as glasses and cups, and, more particularly, to a lid for preventing accidental spillage of the liquid within the container while allowing a person to drink the liquid from the container without removal of the lid.

2. Description of the Related Art

When liquids, such as milk, juice, coffee, tea, soda pop, and the like, are carried in cups or glasses in moving vehicles, such as airplanes, trains, buses, or cars, the irregular movement of the vehicle often causes the liquid to splash within the container. Also, sudden or abrupt movements can cause the container to be tipped over or dropped. When children are learning to use cups for drinking they do not always set the cup down in the upright position. Children experimenting with a new situation will try to splash the liquid inside the container or will set the container down in a totally inverted position. All of these situations can lead to the liquid spilling, thus causing staining of fabrics, or skin burns from hot liquids.

Many attempts have been made to provide a container and cover for preventing the splashing, the spilling of liquids for use in moving vehicles. However, such attempts have resulted in cups, containers, and covers that are expensive to produce, difficult and cumbersome to use, and typically provide that the container and cup be made to accommodate one another, so that a universal lid for use in many different types of containers has not been produced.

An example of a container lid that attempts to solve these problems is shown in U.S. Pat. No. 4,915,250 issued Apr. 10, 1990 to George W. Hayes, Jr. The Hayes lid addresses the problem of splashing and tipping with the lid in a tilted or sideways position. However, the Hayes lid does not completely solve the problem of leakage when the lid is placed in a completely inverted position. Specifically, the Hayes reference discloses in column 3, lines 1–3 relenting to when the cup is in the inverted position "the liquid will still not exit the container, since the vent will also be blocked by liquid and atmospheric pressure will keep the liquid locked in the container." Also, the Hayes reference discloses in column 6, lines 18–21 that "any shape can be used as long as the chamber extends from one edge of the lid, across the lid, and back again to achieve the spill-proof characteristics." This teaching has disadvantages in that atmospheric pressure alone will not keep the liquid from spilling in all likely encountered circumstances. Constant removal and replacement of the lid will result in wear which can allow leakage air, thereby over time equalizing the pressure and causing the liquid to leak. When the liquid is a carbonated or hot, the pressure created can overcome the atmospheric pressure, thereby permitting leakage.

It is, therefore, an object of the present invention to provide an improved lid for a container to prevent spilling of liquid from the container when the container is in a horizontal or even inverted position and to prevent splashing of the liquid from the container when the container is in a vertical position.

Another object of the invention is to provide such a lid that is able to be used with standard containers and does not need a customized container to be adapted to it.

Another object of the invention is to provide such a lid that is relatively simple and inexpensive to manufacture.

SUMMARY OF THE INVENTION

In accordance with the above-stated objects, the present invention provides a spill-proof lid for use with a container for liquids. The lid includes a cover plate for covering the open end of the container. The periphery of the plate is constructed to sealingly engage the upper edges of the walls of the container in a conventional manner to provide a spill-proof attachment between the lid and the container. The lid includes a first liquid chamber that has an inlet end that opens below the lower surface of the plate so that it is in fluid communication with the interior of the container and an outlet end that opens above the upper surface of the plate so that it is in fluid communication with the environment outside the container. The inlet and outlet of the liquid chamber are closely adjacent to one another and are preferably located near an edge of the plate. As the chamber extends from the inlet to the outlet, in the preferred embodiment, it extends from the top of the container to the approximate bottom and back again to the top in a continuous loop.

The operation of the cup and lid is such that the basic plate provides splash protection when the cup is in the upright position. When the cup is tilted in the direction of the inlet of the liquid chamber, liquid moves toward the lid and the inlet of the liquid chamber. The liquid enters the inlet of the liquid chamber and rises up the chamber. Due to the liquid seeking its own level, the fluid rises in the chamber only until it is at the same level with the liquid in the container. The fluid cannot rise above this level until the user applies a suction with his mouth. The user places his mouth over the outlet opening of the liquid chamber and produces a suction on the chamber, much like drinking with a straw. The liquid is moved through the chamber from the inlet to the outlet by the suction applied by the user. When the cup is tipped over with no suction being applied by the user, for example, if it is accidentally knocked over, liquid may fill a portion of the liquid chamber; however, the liquid in the chamber will not rise above the level of liquid in the cup and will not reach the other end of the chamber.

The design continues to be spill-proof even when the container is inverted. As the container is tipped, the fluid level rises up the inlet side of the liquid chamber, maintaining the same level of the liquid in the container. As the container passes the horizontal position, the air within the container rises to the container bottom, which is now at level with the lid. The liquid can not over come the gravitational force of traveling up the liquid chamber to the liquid's normal bottom position which is now at the highest elevation.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
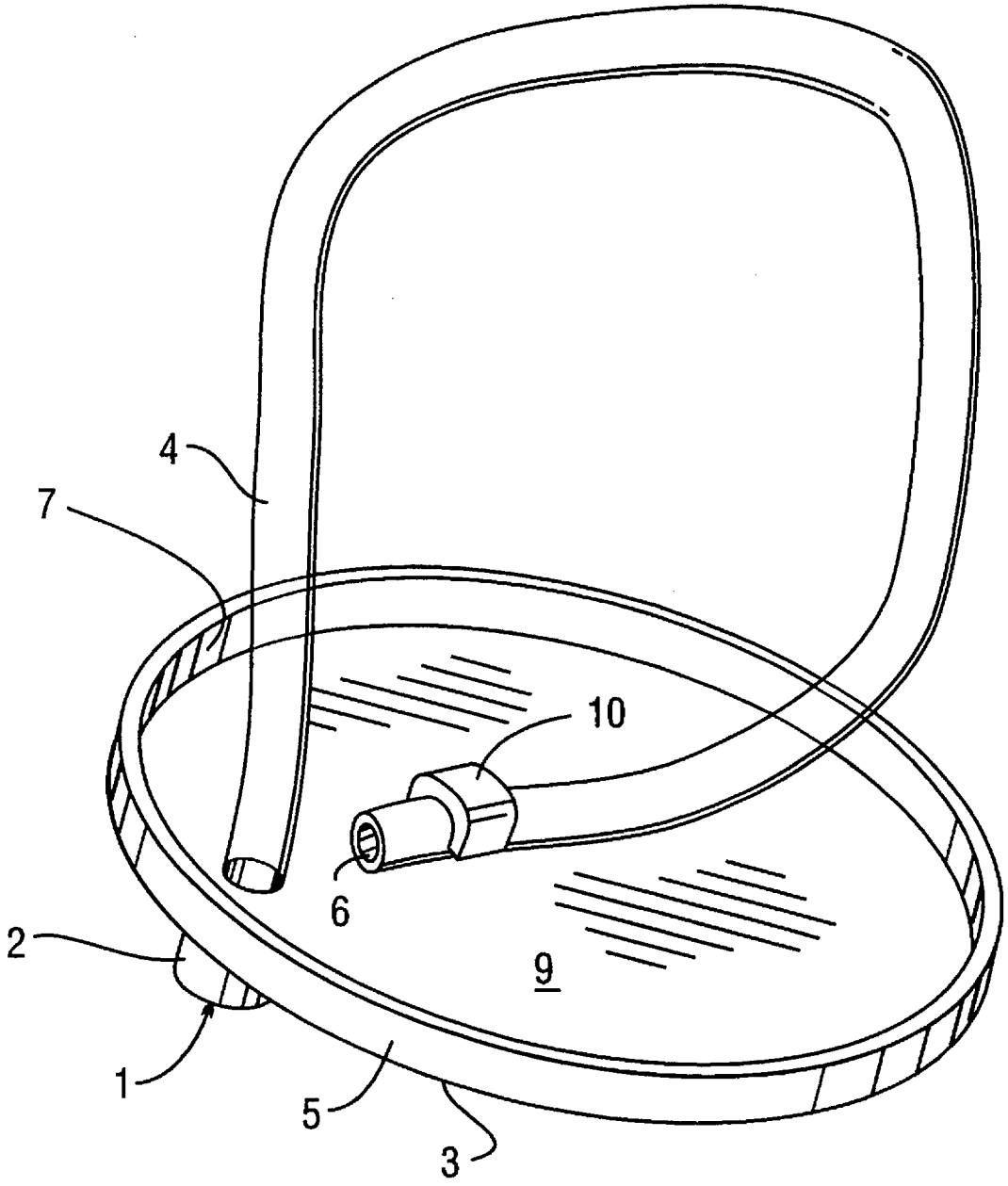
FIG. 1 is a bottom perspective view of a non vented spill-proof lid, according to a preferred embodiment of the present invention.

FIG. 1 shows a preferred embodiment of a spill-proof lid for a container of liquid made in accordance with the principles of the present invention. The lid includes a disk-shaped plate 3 that has an outer periphery 5 formed in an conventional manner so that it is capable of sealingly engaging the upper edge of the wall of a conventional cylindrical cup or glass. The lid also includes a liquid chamber 4 that is formed in the shape of single-loop helix that has an outlet end 1 that opens above the disk-shaped plate 3 and descends downwardly, then loops back up to an inlet end 6, inlet end 6 is held in place by the holding clip 10, holding clip 10 is located below the level of the disk 3 and radially closely adjacent the first outlet end 1. The liquid chamber 4 is an elongated hollow tube open at both ends.

Figure 2:
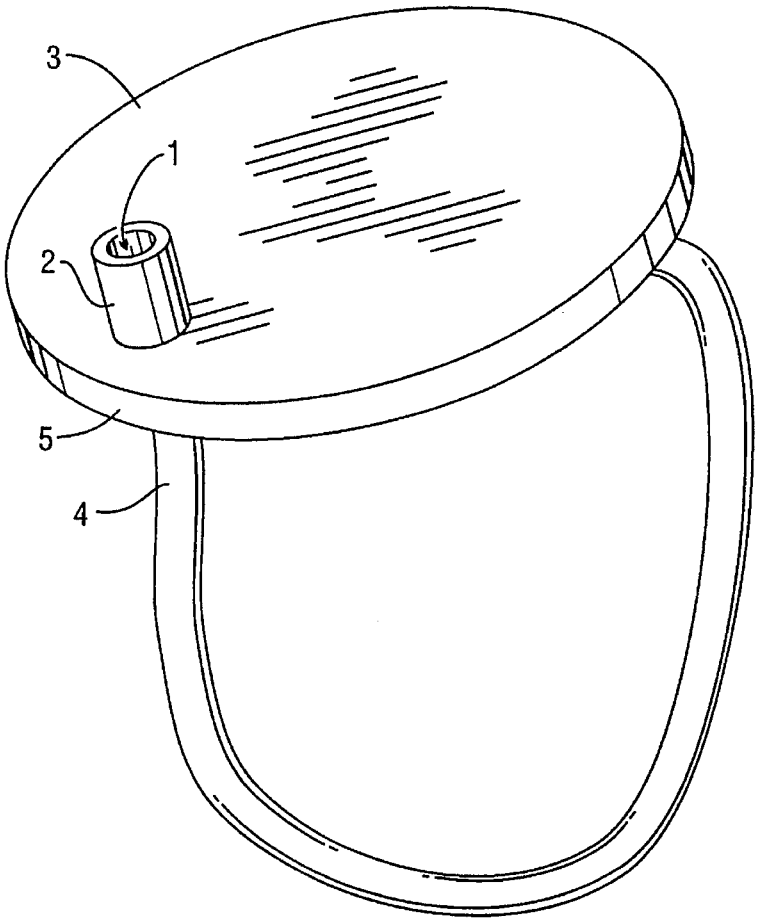
FIG. 2 is a top perspective view of the non vented spill-proof lid of FIG. 1.

FIG. 2 is a top perspective view of the preferred embodiment of the present invention showing the disk-shaped plate 3, the liquid chamber outlet end 1, and a liquid chamber outlet extension 2. The liquid chamber outlet extension 2 provides a pressured tight seal for receiving and holding in place the liquid chamber outlet 1.

Figure 3:
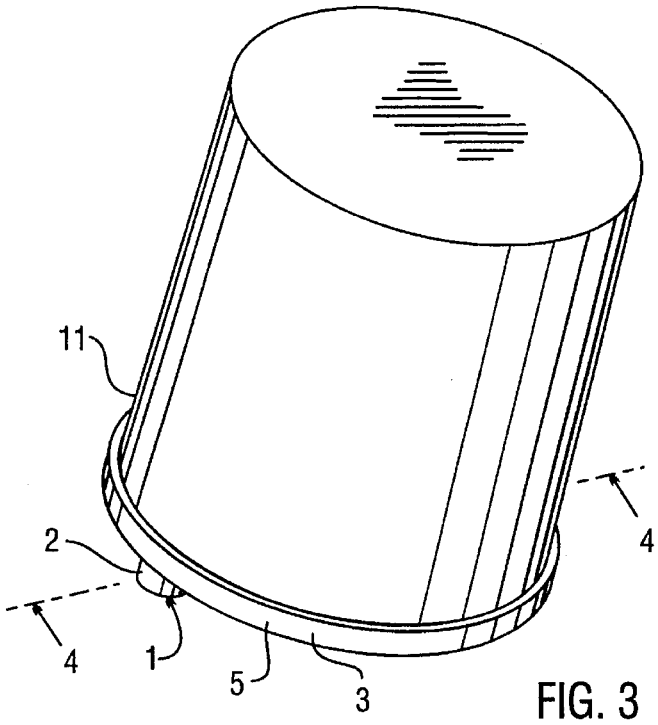
FIG. 3 is a bottom perspective view of non vented spill-proof lid shown installed on a container in the inverted position.

FIG. 3 is the view of FIG. 1 shown with a container 11 installed.

Figure 4:
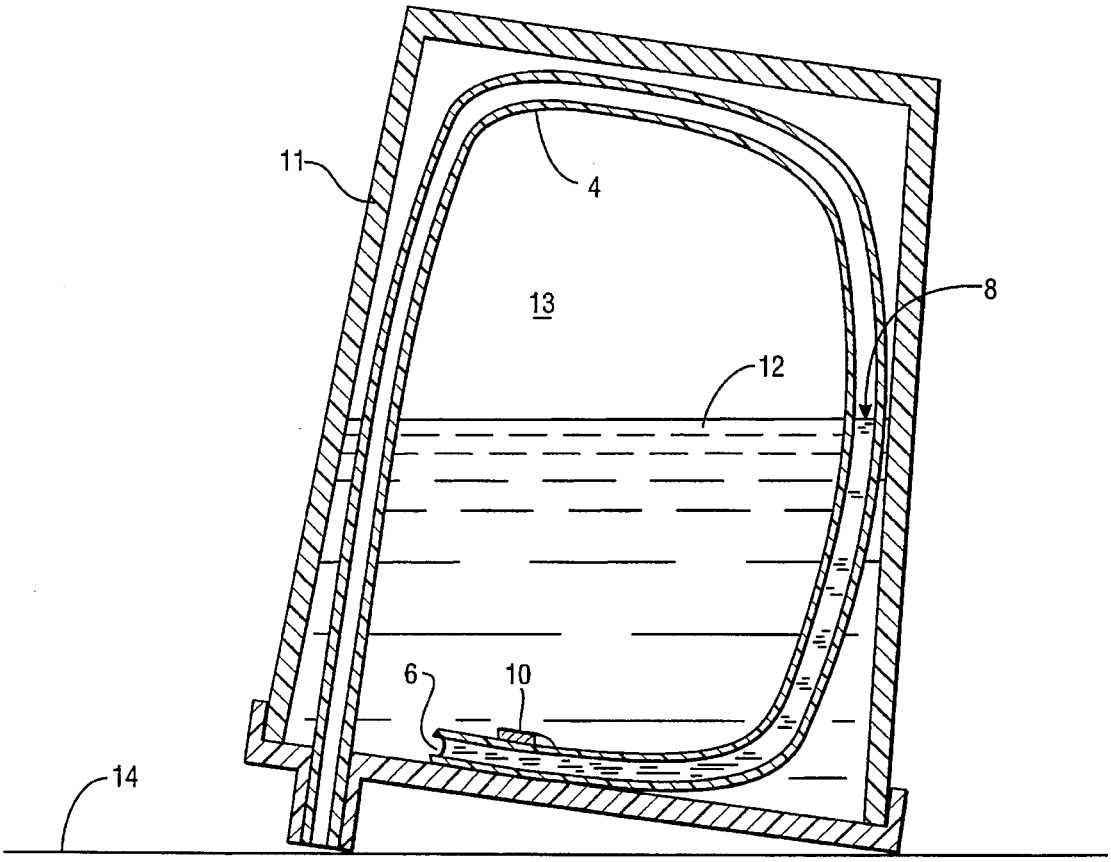
FIG. 4 is a cross-sectional view of the non vented spill-proof lid of FIG.3 taken along lines 4—4, shown with a liquid in the container.

FIG. 4 is a sectional view showing the spill-proof lid of FIG. 1 in use, connected on the container 11 with a liquid 12 being held inside without spilling in the inverted position. The liquid 12 enters the inlet 6 and travels into the liquid chamber 4 but stops when reaching the intersection 8 of the air pocket 13 and the liquid 12.

2. Operation of the Preferred Embodiment

In operation, a user would place the lid over the open end of a container filled with a liquid and, when the user desired to drink from the container, the user would place their lips over the outlet end 1 of the liquid chamber, onto the extension piece 2, and produce a suction with his mouth, tilting the cup so that the liquid was adjacent to the inlet end 1 of the liquid chamber. The sucking action by the user would act to move the liquid through the liquid chamber 4 and into the mouth of the user, much like the action of a straw.

In the illustrated embodiment the liquid chamber 4 is a clear, flexible plastic tubing that is temporarily held in place by the holding clip 10. When cleaning is required the inlet end of the liquid chamber 4 can be removed from the holding clip 10 so that the liquid chamber 4 can be straightened. This allows for a pipe cleaner type device to be used to pass through the now straightened liquid chamber 4. After cleaning, the liquid chamber 4 can be placed back into the original looped position by being held in place by holding clip 10.

While preferred embodiments of the invention have been discussed and illustrated, it should be understood by those of ordinary skill in the art and other that changes can be made to the illustrated embodiment without departing from the spirit and scope of the present invention. For example, while a single loop is shown, it would be possible to create a plurality of loops both horizontally and vertically to achieve the same spill-proof characteristics.

The foregoing description of the preferred embodiment of the present invention has been presented for purposes of illustration and description. It is not intended to be exhaustive or to limit the present invention to the precise form disclosed and obviously many modifications and variations are possible in light of the above teachings. It is intended that the scope of the present invention be broadly defined by the claims which follow.

What is claimed is:

1. A spill proof lid for use with a container for liquids, said lid comprising:

a cover plate for covering an open end of said container, said cover plate having a periphery constructed to sealingly engage the wall of said container; and a single closed tubular liquid chamber which runs through the upper surface of said cover plate downward, then looping up to the under side of said cover plate, said chamber having a single inlet opening below the lower surface of said plate and affixed to said lower surface, said single inlet opening further being in communication with the interior of said container when said lid is in place on said container and an outlet opening in said upper surface of said plate, in communication with the space outside said container, said inlet opening and outlet opening being closely adjacent one another and said liquid chamber being constructed and arranged such that when the container is tilted from the vertical, liquid moving from said inlet opening to said outlet opening of said container must rise above the level of liquid in the container, thereby preventing leaking or spilling of the liquid from said container.

2. The lid according to claim 1, wherein said liquid chamber extends from the top of the container to the approximate bottom and back again to the top in a continuous loop.

3. The lid according to claim 1, further comprising a mouthpiece formed on the upper surface of said plate in register with said outlet opening and extending from said plate.

4. A spill proof lid for use with a container for liquids, said lid comprising:

a cover plate for coveting an open end of said container, said cover plate having an upper surface, an underside and a periphery constructed to sealingly engage the wall of said container; and a generally elongated, tubular liquid chamber which runs through said upper surface of said cover plate downward, then looping up to said under side of said cover plate, said tubular liquid chamber having an inlet opening below said lower surface of said plate, said inlet opening being in communication with the interior of said container when said lid is in place on said container and an outlet opening in said upper surface of said plate, in communication with the space outside said container, said inlet opening and outlet opening being closely adjacent one another and said liquid chamber being constructed and arranged such hat when the container is tilted from the vertical, liquid moving from said inlet opening to said outlet opening of said container must rise above the level of liquid in the container, thereby preventing leaking or spilling of the liquid from said container; and attachment means for attaching said single, closed, tubular liquid chamber to said underside of said cover plate.

5. The lid according to claim 4, wherein said attachment means comprises a holding clip formed on the under surface of said plate in register with said inlet opening and extending from said plate.

* * * * *